US006408983B1

(12) United States Patent
Widurski

(10) Patent No.: US 6,408,983 B1
(45) Date of Patent: Jun. 25, 2002

(54) LADDER STABILIZING DEVICE

(76) Inventor: Eugene Widurski, 833 Marshall Ave., Pittsburgh, PA (US) 15214

( * ) Notice: Subject to any disclaimer, the term of this patent is extended or adjusted under 35 U.S.C. 154(b) by 0 days.

(21) Appl. No.: 09/655,323

(22) Filed: Sep. 5, 2000

(51) Int. Cl.[7] ..... E06C 7/00
(52) U.S. Cl. ..... 182/107; 182/214
(58) Field of Search ..... 182/107, 214

(56) References Cited

U.S. PATENT DOCUMENTS

| | | | | | |
|---|---|---|---|---|---|
| 230,459 | A | * | 7/1880 | Baker | 182/214 |
| 274,448 | A | * | 3/1883 | Kinzel | |
| 1,541,402 | A | * | 6/1925 | Seaman | 182/107 |
| 2,592,006 | A | | 4/1952 | Burke | |
| 2,732,264 | A | * | 1/1956 | Smith | 182/214 |
| 3,072,218 | A | | 1/1963 | Peters | |
| 3,715,012 | A | | 2/1973 | Perry | |
| 4,331,217 | A | * | 5/1982 | Stecklow | 182/107 |
| 4,593,790 | A | | 6/1986 | Brewer et al. | |
| 5,323,875 | A | | 6/1994 | Kennett | |
| 5,373,913 | A | | 12/1994 | Santos | |
| 5,850,894 | A | | 12/1998 | Busenhart | |

FOREIGN PATENT DOCUMENTS

| | | | | |
|---|---|---|---|---|
| CH | 250048 | * | 5/1948 | 182/214 |
| DE | 141308 | * | 5/1903 | 182/214 |
| GB | 2012341 | * | 7/1979 | 182/214 |

* cited by examiner

*Primary Examiner*—Alvin Chin-Shue
(74) *Attorney, Agent, or Firm*—Aileen Champion Addessi

(57) ABSTRACT

A ladder stabilizing device is provided for removable securement to the upper ends of the spaced-apart stiles of a ladder in order to position the ladder a predetermined distance from the vertical wall surface of a building structure and which allows the ladder to be leaned against an inside and outside corner of the structure includes a pair of ladder stabilizing support members, and each support member includes an elongated main body portion for spacing the ladder from the vertical wall surface, a socket receiving portion into which the upper end of one stile is inserted, and a wall contacting portion opposite the socket receiving portion and which diverges from the longitudinal axis of the main body portion for engaging the particular wall surface.

4 Claims, 3 Drawing Sheets

LADDER STABILIZING DEVICE

BACKGROUND OF THE INVENTION

The present invention relates to devices that are attachable to ladders, and, more particularly, pertains to a device which stabilizes and supports a ladder against a vertical wall surface and which also allows the ladder to be leaned with stability against an inside or outside corner of a building structure.

Ladders have a variety of uses in the construction, building, painting, home repair and remodeling trades as well as for ordinary home maintenance and upkeep tasks. Ladder sizes range from small six foot ladders used for simple home maintenance jobs, such as replacing light bulbs and painting rooms, to 30 foot long extension ladders used by painting and window washing crews; and the two most common types of ladders are the fold-out stepladder and the lean-on ladder. Ladders must be used with care and caution, and their improper use has often led to the serious injury, and, on occasion, death of the user.

For example, in using the lean-on type of ladder that must be supported against a vertical wall surface, a number of factors must be considered for the safe deployment and use of this type of ladder. The ground surface on which the lowermost ends of the stiles of the ladder are placed should be flat, stable, and unyielding; although blocks or shims, usually of wood, are often used to compensate for uneven terrain, this practice isn't recommended as it may actually destabilize the ladder when the ladder is disposed for use. In addition, the angle of lean against the supporting wall surface is another important consideration. An angle of lean that is too shallow may cause the upper ends of the ladder stiles to indent or damage the supporting wall surface, especially if the wall surface is aluminum siding, by producing what in effect is an overhung load that occurs when the user climbs to the uppermost rungs of the ladder and then leans with his or her full weight on the upper end of the ladder, thereby pressing the upper end against the vertical wall surface. Contrawise, an angle of lean that is too steep with respect to the ground surface will cause the ladder to be unstable and unsafe insofar as the user's movement will be limited for fear the ladder will topple backward. The user will also be prevented from leaning back and away from the vertical wall surface to reach hard-to-get places while, for instance, painting the exterior of a second story house that includes numerous dormers and gables. When using lean-on ladders, a slope or angle of lean of approximately 70 degrees with respect to the ground surface is regarded as the optimum ladder position. Nonetheless, due to the uneven terrain the lean-on ladder is set upon, the particular wall surface being worked on, and the haste with which ladders are often deployed, this optimum angle is often not obtained and, thus, the lean-on ladder is deployed in an unsteady, unsafe manner.

The above problems are compounded when the portion of the vertical wall surface to be painted or furnished with aluminum siding is the inside or outside corner of the wall surface, which generally forms a right angle; although occasionally such corners can form a beveled angle. One way to paint or affix aluminum siding to such an area when using a lean-on ladder is for the user to simply position the ladder against one corner wall surface and perform the requisite task, and then dismount the ladder, reposition the ladder against the adjacent corner wall surface, and continue with the performance of the task at hand. This method obviously requires the positioning, mounting, dismounting, repositioning and mounting of the lean-on ladder against both adjacent wall surfaces a number of times to complete the task. Depending upon the size and area of the adjacent wall surfaces and the task to be performed, this continual up and down climbing, and moving of the ladder, can become aggravating and tiresome.

Thus, the prior art discloses a number of devices for stabilizing ladders, especially lean-on ladders, against flat, vertical wall surfaces, and also positioning such lean-on ladders against vertical wall surfaces that meet to form an inside or outside corner.

The Kinzel patent (U.S. Pat. No. 274,448) discloses a ladder attachment which includes a pair of boxes that can be slipped onto the uppermost end of the ladder, and each box has an externally mounted roller for contacting wall surfaces that meet at an inside or outside corner.

The Burke patent (U.S. Pat. No. 2,592,006) discloses a ladder attachment that connects to the ladder rungs and has a brace member, which leans on the roof of a structure.

The Peters' patent (U.S. Pat. No. 3,072,218) discloses a ladder bracket which hooks onto the uppermost rungs of the ladder, and includes telescoping leg members which allows the lean-on ladder to be supported against an inside or outside corner wall surfaces.

The Perry patent (U.S. Pat. 3,715,012) discloses a v-shaped safety ladder device that allows a lean-on ladder to be positioned against a telephone pole.

The Brewer et al. Patent (U.S. Pat. No. 4,593,790) discloses a convertible ladder stabilizer that hooks onto the upper ends of the stiles of the ladder for supporting the ladder against various configurations of wall surfaces.

The Kennett patent (U.S. Pat. No. 5,323,875) discloses a v-shaped, one-piece standoff brace which partially projects between the rungs of a lean-on ladder, and which connects to the ladder stiles. The stand-off brace also includes legs which are most easily accommodated to flat surfaces and outside corner surfaces.

The Santos patent (U.S. Pat. No. 5,373,913) discloses a ladder stabilizer which includes adjustable leg extensions into which the lower ends of the ladder stiles are inserted, and coupling cables which attach to horizontal wall cables for supporting a lean-on ladder against a building structure.

The Busenhart patent (U.S. Pat. No. 5,850,894) discloses a ladder kit, which is preferably factory assembled to the lean-on ladder.

However, despite the ingenuity of the above devices, there remains a need for a ladder stabilizing device which easily mounts to a ladder, spaces the ladder from the wall surface a sufficient distance to allow the user ample maneuvering room when working on the wall surface, and which can support the ladder against a variety of vertical wall surfaces.

SUMMARY OF THE INVENTION

The present invention comprehends ladder stabilizers, and, more particularly, comprehends a ladder stabilizing device that is removably securable to the uppermost ends of the stiles of a lean-on ladder for allowing the lean-on ladder to be positioned against a flat vertical wall surface as well as vertical wall surfaces that meet to form inside and outside corners, whether at right or beveled angles.

The ladder stabilizing device of the present invention includes a pair of ladder stabilizing support members each of which is removably securable to each respective uppermost end of each ladder stile. Each ladder stabilizing support member includes an elongated main body portion, a box-shaped socket portion integrally formed from the main body portion and having an opening for inserting and receiving therein the uppermost end of each ladder stile, and a wall contacting portion integrally formed from the main body portion and located opposite of the socket receiving portion. At least one elongated connection bar extends between, and is secured to, each ladder stabilizing support member adjacent each main body portion in order to interconnect the ladder stabilizing support members and to prevent them from swiveling or pivoting when they are attached to the uppermost end of each respective ladder stile.

It is an objective of the present invention to provide a ladder stabilizing device which fits all sizes and types of ladders, especially lean-on ladders of both the extendible and non-extendible type.

It is another objective of the present invention to provide a ladder stabilizing device which allows the user to position the ladder adjacent to vertical wall surfaces that meet or form inside and outside corners.

Yet another objective of the present invention is to provide a ladder stabilizing device which can position the upper part of a lean-on ladder a sufficient distance from the vertical wall surface for allowing the user room to maneuver when performing work on the vertical wall surface.

These and other objects, features, and aspects of the invention will become clear from a reading of the detailed description of the invention, the accompanying figures, and the appended claims.

BRIEF DESCRIPTION OF THE DRAWINGS

While the specification concludes with claims particularly pointing out and distinctly claiming the subject matter of the invention, it is believed the invention will be better understood from the following description, taken in conjunction with the following drawing, wherein;

DESCRIPTION OF THE PREFERRED EMBODIMENT

Figure 1:
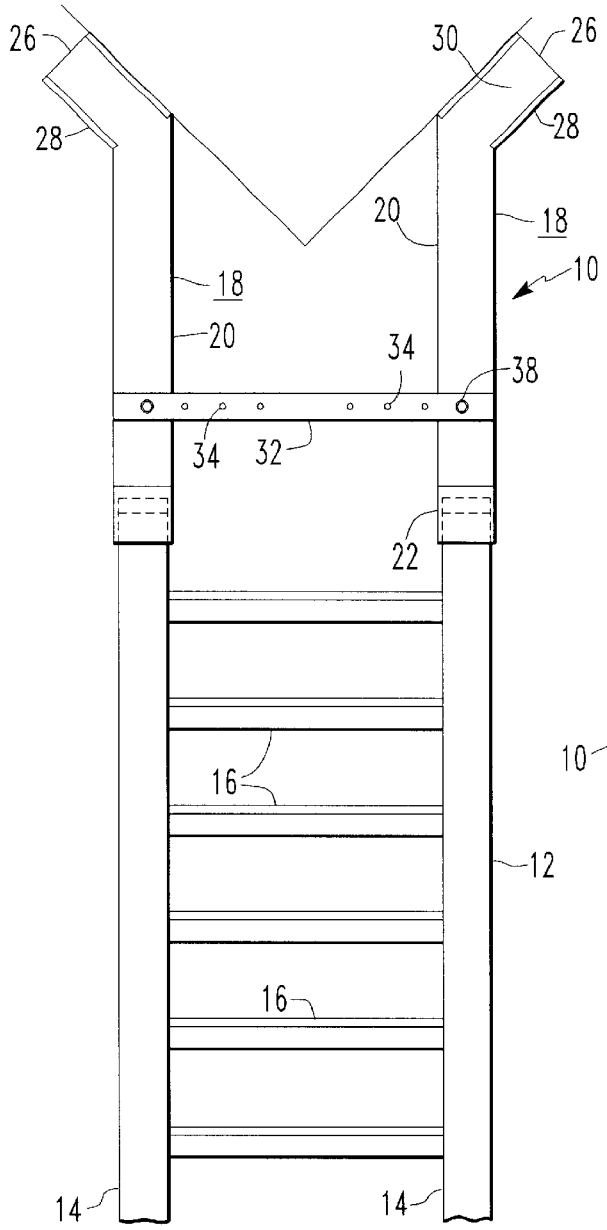
FIG. 1 is a top plan view illustrating the attachment of the ladder stabilizing device to the stiles of a lean-on ladder for supporting the lean-on ladder against two wall surfaces that meet to form an outside corner.

Illustrated in FIGS. 1–4 is a ladder stabilizing device 10 which is adapted for removable attachment to a lean-on type of ladder 12 that is normally disposed contiguous to a vertical wall surface for proper use. The lean-on ladder 12, which may be of the extendible or non-extendible type, includes one pair of opposed stiles 14 interconnected by a plurality of rungs 16 that are horizontally oriented when the ladder 12 is disposed in its operative position. The uppermost ends of each ladder stile 14 normally directly and physically contact the wall surface when the lean-on ladder 12 is disposed against the wall surface and are free of a ladder rung so as not to interfere with the placement of the lean-on ladder 12 against the wall surface. The ladder stabilizing device 10 of the present invention is adapted for removable securement to the uppermost ends of each stile 14, and the device 10 doesn't need or require securement to the ladder rungs 16 or to any portion of the particular wall surface for proper use.

As shown in FIGS. 1–4, the ladder stabilizing device includes two primary structural members referred to as ladder stabilizing support members 18. Each ladder stabilizing support member 18 is preferably an elongated structure manufactured from aluminum, steel or fiberglass. The ladder stabilizing support members 18 may be hollow, tubular structures throughout their length or they may be substantially solid throughout their length. The length of each ladder stabilizing support member 18 is such as to securely support the lean-on ladder 12 against the wall surface but will also space the upper portion of the lean-on ladder 12 a sufficient distance from the particular vertical wall surface to thereby afford the individual ample room to maneuver for reaching awkward, hard-to-reach areas, while performing work on any type of structure, such as a building or house.

As illustrated in FIGS. 1–4, each ladder stabilizing support member 18 includes a straight, elongated main body portion 20 that defines a longitudinal axis that extends through the main body portion 20. Integrally formed from the main body portion 20 is a box-shaped socket receiving portion or ladder stile socket portion 22 that includes a hollow or opening 24 that can slidably receive therein the uppermost end of each ladder stile 14. The dimensions of each opening 24 are sized to receive the ends of ladder stiles of all types of lean-on ladders. As shown most clearly in FIGS. 3 and 4, when the ladder stabilizing support members 18 are placed onto the upper ends of the ladder stiles 14, each socket receiving portion 22 is located in the same vertical plane as the main body portion 20.

Figure 3:
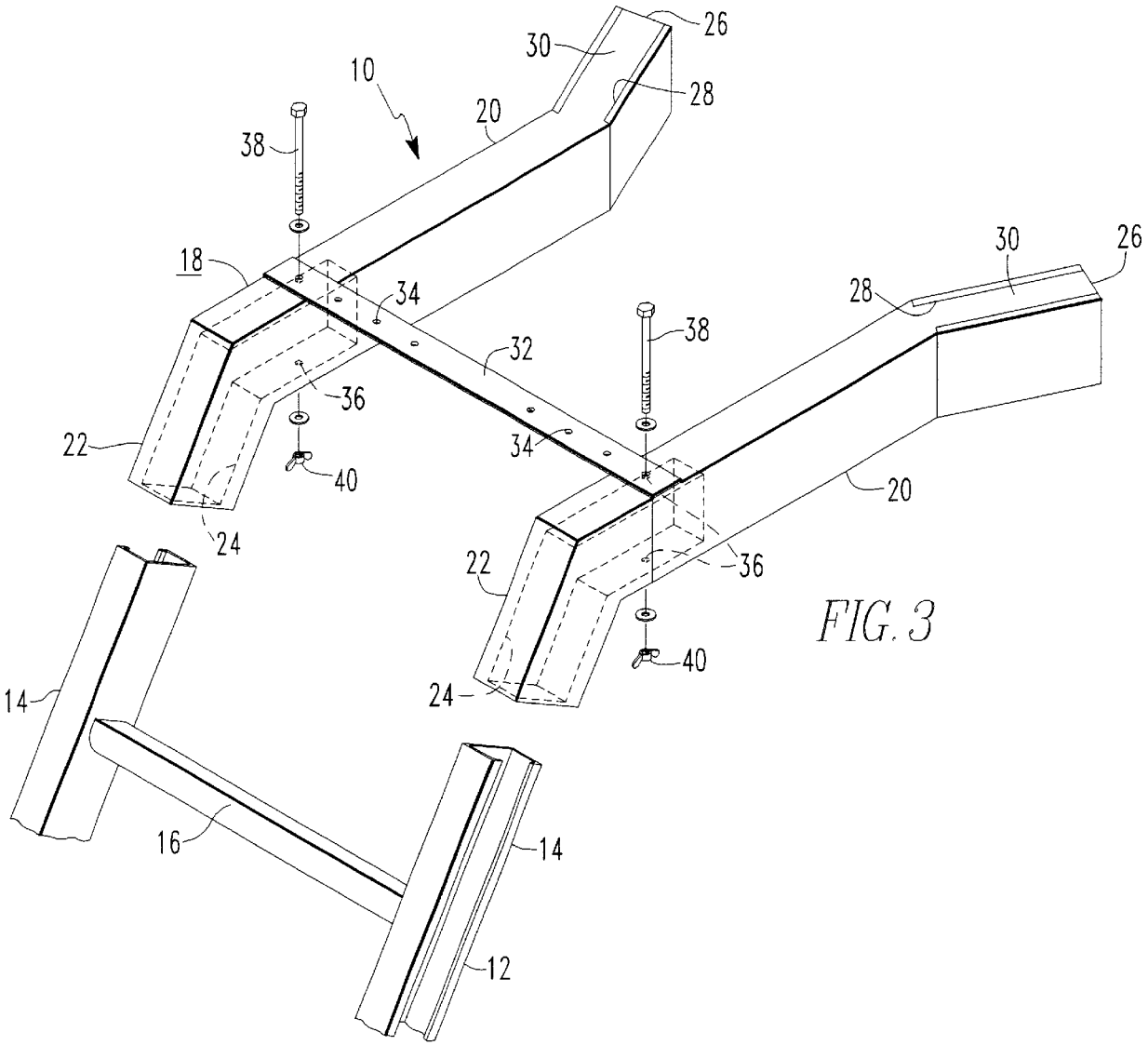
FIG. 3 is a perspective view of the ladder stabilizing device first shown in FIG. 1.
Figure 4:
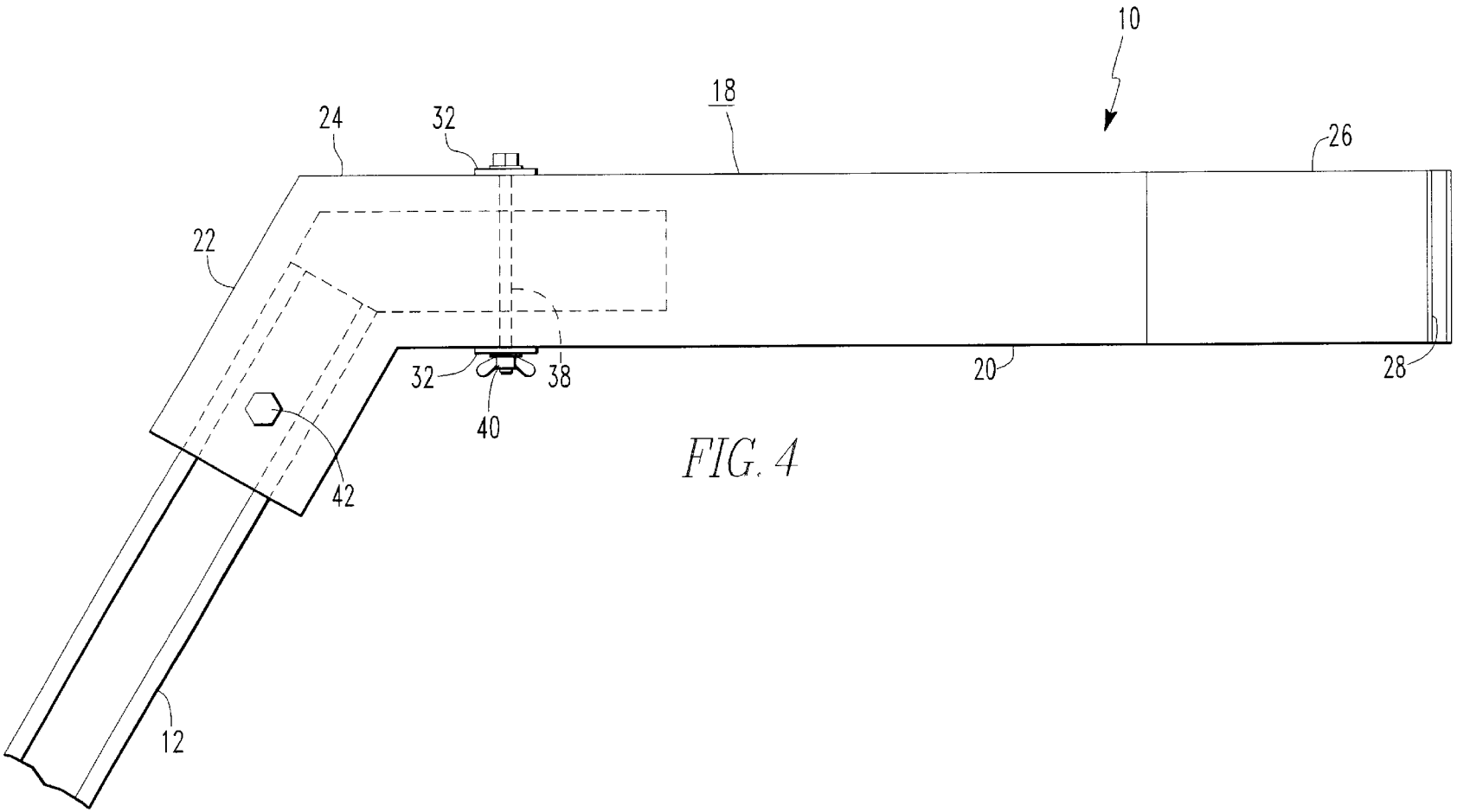
FIG. 4 is a side elevational view of the ladder stabilizing device showing the insertion of an upper end of one ladder stile into the socket receiving portion of the ladder stabilizing device.

However, as shown in FIGS. 3 and 4, each socket receiving portion 22 also diverges from, and has an angular displacement with respect to the longitudinal axis that is defined by the rectilinear main body portion 20. The angular displacement of each socket receiving portion 22 from the main body portion 20 is approximately 120 degrees, and this angular divergence diminishes or reduces the slope or incline of the lean-on ladder 12 with respect to the particular wall surface the ladder 12 is supported against by the ladder stabilizing device 10.

Figure 2:
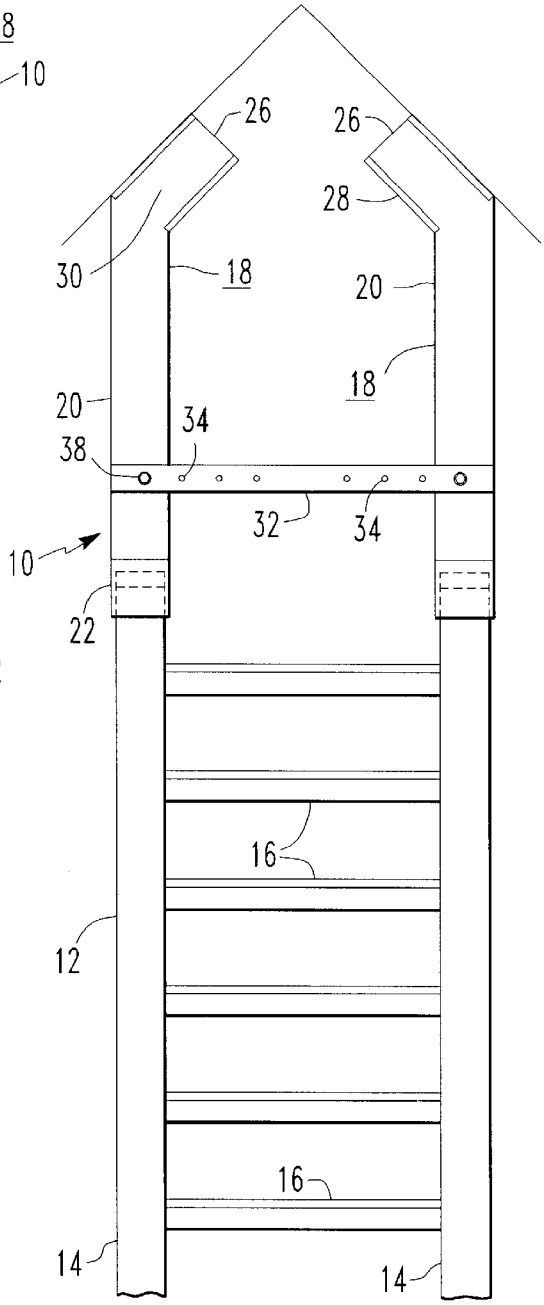
FIG. 2 is a top plan view illustrating the attachment of the ladder stabilizing device of the present invention to the stiles of a lean-on ladder for supporting the lean-on ladder against two wall surfaces that meet to form an inside corner.

As illustrated in FIGS. 1–4, each ladder stabilizing support member 18 also includes a wall contacting or abutting portion 26 that is integrally joined to the main body portion 20 and extends outwardly therefrom. More specifically, each wall contacting portion 26 is located opposite of each socket receiving portion 22, and each wall contacting portion 26 diverges from the longitudinal axis that is defined by each respective main body portion 20. As shown in FIGS. 1 and 2, the angular divergence of each wall contacting portion 26 is away from the vertical plane in which each socket receiving portion 22 and main body portion 20 are located when the ladder stabilizing device 10 is mounted in its operative position to the upper ends of the ladder stiles 14. The angular displacement or divergence of each wall-contacting portion 26 from the longitudinal axis of each main body portion 20 is approximately 155 degrees. This angle of divergence allows for the interchangeable and reversible securement of the ladder stablilizing support members 18 to each ladder stile 14 so that the support members 18 can accommodate and be used against vertical wall surfaces that meet at both right-angled inside and outside corners; and also with vertical wall surfaces that meet to form beveled inside and outside corners. Moreover, the angular displacement of the wall contacting portions 26 from the socket receiving portions 22 are in separate planes that are 90 degrees from each other.

As shown in FIGS. 1–4, the wall contacting portions 26 are generally rectangular-shaped and may have some type of padding 28 affixed to each external surface 30 to prevent marring or damaging of the wall surface that is engaged by each wall contacting portion 26 when the ladder stabilizing device 10 is placed on the upper ends of the ladder stiles 14 and the ladder 12 is then positioned adjacent the wall surface. The padding 28 is preferably a standard ladder mitten, which can be easily slipped over the end of each wall-contacting portion 26. The padding 28 can also be some type of durable rubber strips adhered by an epoxy to at least two of the four external surfaces 30 presented by each wall contacting portion 26.

As shown in FIGS. 1–4, a structural member is necessary to interconnect both ladder stabilizing support members 18. Otherwise, without some kind of interconnecting structural member, after each ladder stabilizing support member 18 is secured to the upper end of each ladder stile 14, and the lean-on ladder 12 is positioned adjacent the wall surface so that the wall contacting portions 26 abut the wall surface, as the individual climbs to the top of the ladder, his or her weight bearing upon the upper end of the ladder 12 would cause each independently mounted ladder stabilizing support member 18 to swivel or pivot on the stiles 14 and slide against the wall surface and bowing outward or inward. In addition to damaging the particular wall surface, the above movements of the support members 18 could easily destabilize the ladder 12 and cause the individual to be injured by throwing the individual from the ladder 12.

Therefore, as shown in FIGS. 3 and 4, a structural interconnect member is required to maintain the disposition of each ladder stabilizing support member 18 when they are placed on the upper ends of the ladder stiles 14. The present invention thus includes at least one elongated connection bar 32 having opposed ends and a plurality of equidistantly spaced bolt holes 34. The connection bar 32 can be a flat piece of light or medium steel, and in order to secure the bar 32 to each main body portion 20 of each support member 18, the individual would first align the holes 34 on the connection bar 32 over each receiving hole 36 that is located at the place where the main body portion 20 merges with the socket receiving portion 22. The individual would then insert bolts 38 downwardly through each bolt hole 34 and receiving hole 36 and secure the bolts 38 to the connection bar 32 and the support members 18 threading a nut, such as a wing nut 40, onto the shanks of the bolts 38 that project through the opposite ends of each main body portion 20. Although one connection bar 32 will maintain the parallel alignment of the ladder stabilizing support members 18 when the device 10 is mounted onto the upper ends of the ladder stiles 14 when the ladder 12 is brought into engagement with the particular wall surface, two connection bars could be used to further enhance the stability of the device 10.

In order to increase the positive engagement of the socket receiving portions 22 to the upper end of each ladder stile 14, an adjustable member 42, such as a thumb screw or set screw, may be inserted through a small bore located on one of the external surfaces 30 of each socket receiving portion 22 and tightly against the upper end of each respective ladder stile 14 that has been received therein. Thus, the adjustable members 42 provide a positive contacting surface against each upper end of each ladder stile 14 and thereby further assist in maintaining the securement of the ladder stabilizing support members 18 to the upper ends of the ladder stiles 14.

FIGS. 1 and 2 illustrate the adaptability of the ladder stabilizing device 10 to two wall surfaces that meet at both outside and inside corners, and also the interchangeability of each ladder stabilizing support member 18 on the upper ends of each ladder stile 14 for accommodating two inside corner surfaces and two outside corner surfaces.

To store the ladder stabilizing device 10, the bolts 38 are loosened and the support members 18 and connection bar 32 are pivoted with respect to one another enabling the support members 18 to be folded toward one another. The bolts 38 are then re-tightened to compactly store and contain all of the components of the ladder stabilizing device 10.

The foregoing is considered illustrative only of the principles of the invention. Since numerous modifications and changes will readily occur to those skilled in the art, it is not desired to limit the invention to the construction and operation shown and described. Accordingly, all suitable modifications and equivalents may be resorted to, falling within the scope of the invention.

I claim:

1. A ladder stabilizing device for attachment to the upper ends of the stiles of a ladder for supporting the ladder against a flat wall surface and the inside and outside corner surfaces of two adjoining wall surfaces of a building structure, the ladder stabilizing device comprising:

a pair of interchangeable, elongated ladder stabilizing support members adapted for removable securement to the respective upper ends of the stiles of the ladder;

each ladder stabilizing support member including a box-shaped socket receiving portion having a stile receiving opening for allowing the upper end of one ladder stile to be slidably received therein, an elongated main body portion having a longitudinal axis with the box-shaped socket receiving portion being integrally joined to the main body portion and the box-shaped socket receiving portion having an angular displacement from the main body portion of approximately 120 degrees, and a wall contacting portion integrally joined to the main body portion opposite the socket receiving portion and which extends outwardly from the main body portion at an angular displacement of approximately 155 degrees with respect to the axis of the main body portion whereupon the wall contacting portion can abut the flat and adjoining wall surfaces so that the main body portion can space the ladder from the wall surfaces of the building structure when the ladder stabilizing members are secured to the upper ends of the ladder stiles thereby supporting the ladder adjacent to the wall surfaces of the building structure;

the socket receiving portion, the main body portion, and the wall contacting portion having a constant rectangular cross-section throughout for providing a continual rectangular cross-section from the stile receiving opening, through the socket receiving portion, along the main body portion, and through the wall contacting portion of the ladder stabilizing support members;

each wall contacting portion and socket receiving portion of each ladder stabilizing support member having an angular displacement from each other in separate planes that are approximately 90 degrees from each other;

at least two elongated connection bars positioned parallel to one another and having the main body portion of the ladder stabilizing support member positioned therebetween, each of the connection bars having a pair of opposite attachment ends so that each attachment end can be secured to the main body portions of each respective ladder stabilizing support member, each attachment end having a plurality of holes so that the distance between each ladder stabilizing support member can be varied for allowing the selective adjustment of the spatial distance between the ladder stabilizing support members in order to accommodate variously sized ladders and then fixed by the connection bars in order to maintain the ladder stabilizing support members in a fixed parallel relationship with respect to each other when the ladder stabilizing support members are mounted to the upper ends of the ladder stiles;

the ladder stabilizing support members capable of interchangeable securement to the respective upper ends of the ladder stiles so that in one configuration the ladder stabilizing support members can support the ladder adjacent the inside corner surfaces of adjoining wall surfaces and, after interchanging on the upper ends of the ladder stiles, the ladder stabilizing support members can form a second configuration for supporting the ladder adjacent the outside corner surfaces of adjoining wall surfaces;

each of the wall contacting portions of the ladder stabilizing support members having one external contact surface for contacting either the inside or outside corner surface of the building structure, the contact surfaces diverge outward and away from each other when configured to support the ladder adjacent outside corner surfaces of adjoining wall surfaces, the same contact surfaces diverge inward and toward each other when the ladder stabilizing support members are interchanged for configuring the contact surfaces to support the ladder adjacent inside corner surfaces of adjoining wall surfaces, and the connection bars and the stabilizing support members pivotally connected together and foldable for collapsing the stabilizing support members toward one another for compactly containing the ladder stabilizing device during storage.

2. The ladder stabilizing device of claim 1 wherein each ladder stabilizing support member includes at least one padding member affixed to at least one wall contacting portion so that the wall contacting portion does not mar the vertical wall surface of the building structure when the ladder stabilizing members are mounted to the upper ends of the ladder stiles and brought into engagement with the vertical wall surface.

3. The ladder stabilizing device of claim 2 wherein each ladder stabilizing support member includes a pair of padding members affixed to each respective wall contacting portion.

4. The ladder stabilizing device of claim 1 further comprising an adjustable member removably inserted through the socket receiving portion of the ladder stabilizing support member and contacting the upper end of each respective ladder stile for providing positive engagement of the socket receiving portion to the upper end of each ladder stile.

* * * * *